US009694227B2

(12) United States Patent
Powell

(10) Patent No.: US 9,694,227 B2
(45) Date of Patent: Jul. 4, 2017

(54) EXERCISE PEN

(71) Applicant: Ogden Powell, Boynton Beach, FL (US)

(72) Inventor: Ogden Powell, Boynton Beach, FL (US)

(73) Assignee: Ogden Powell, Boynton Beach, FL (US)

( * ) Notice: Subject to any disclaimer, the term of this patent is extended or adjusted under 35 U.S.C. 154(b) by 0 days.

(21) Appl. No.: 14/428,330

(22) PCT Filed: Sep. 17, 2013

(86) PCT No.: PCT/US2013/060098

§ 371 (c)(1),
(2) Date: Mar. 13, 2015

(87) PCT Pub. No.: WO2014/043678

PCT Pub. Date: Mar. 20, 2014

(65) Prior Publication Data

US 2015/0246256 A1 Sep. 3, 2015

Related U.S. Application Data

(60) Provisional application No. 61/702,016, filed on Sep. 17, 2012.

(51) Int. Cl.
*A63B 21/00* (2006.01)
*A63B 21/018* (2006.01)
(Continued)

(52) U.S. Cl.
CPC .. *A63B 21/00043* (2013.01); *A63B 21/00185* (2013.01); *A63B 21/018* (2013.01);
(Continued)

(58) Field of Classification Search
CPC ..... A63B 21/0552; A63B 21/0557; A63B 21/0442; A63B 21/4035; A63B 21/00043;
(Continued)

(56) References Cited

U.S. PATENT DOCUMENTS 3,298,687 A * 1/1967 Douglas ..... A61H 15/0092 482/122
3,312,466 A * 4/1967 Melchiona ..... A63B 21/0004 482/126
(Continued)

FOREIGN PATENT DOCUMENTS

GB 2031285 4/1980
JP 2004290250 10/2004
(Continued)

*Primary Examiner* — Andrew S Lo
(74) *Attorney, Agent, or Firm* — Duane Morris LLP; J. Rodman Steele, Jr.; Gregory M. Lefkowitz

(57) ABSTRACT

An exercise pen includes an elongated body having an elongated upper body and an elongated lower body where a lower end of the upper body and an upper end of the lower body can be releasably coupled together, and a resistance tube extending within lumens of said upper and lower bodies, the resistance tube having a first end coupled to a lower portion of the lower body and a second end, opposite the first end, coupled to an upper portion of the upper body. A method of exercising using the exercise pen includes decoupling the upper body from the lower body; and stretching the resistance tube by moving the upper body away from the lower body. Other embodiments, including an exercise kit having different resistance tubes of different moduli of elasticity are disclosed.

17 Claims, 7 Drawing Sheets

(51) Int. Cl.

| | |
|---|---|
| ***A63B 21/02*** | (2006.01) |
| ***A63B 21/04*** | (2006.01) |
| ***A63B 21/068*** | (2006.01) |
| ***A63B 23/12*** | (2006.01) |
| ***B43K 29/00*** | (2006.01) |
| *A63B 23/00* | (2006.01) |

(52) U.S. Cl.

CPC ..... *A63B 21/026* (2013.01); *A63B 21/028* (2013.01); *A63B 21/0414* (2013.01); *A63B 21/068* (2013.01); *A63B 21/40* (2015.10); *A63B 21/4033* (2015.10); *A63B 21/4035* (2015.10); *A63B 21/4043* (2015.10); *A63B 23/12* (2013.01); *A63B 23/1218* (2013.01); *B43K 29/00* (2013.01); *A63B 2023/006* (2013.01); *A63B 2210/50* (2013.01); *A63B 2210/58* (2013.01)

(58) Field of Classification Search

CPC . A63B 21/0555; A63B 21/4043; A63B 23/12; A63B 21/00061; A63B 21/00069; A63B 23/03541; A63B 21/055; A63B 21/4017; A63B 21/00065; A63B 23/1209; A63B 21/0004; A63B 21/02; A63B 21/0428; A63B 2210/50; B43K 23/008; B43K 23/004; B43K 7/005; B43K 8/003; B43K 5/005; B43K 21/006; B43K 23/001; B43K 29/00; B43K 23/12; B43K 7/12; B43K 19/02; B43K 19/14; B43K 1/08; B43K 23/06; B43K 23/08; B43K 7/00; B43K 29/02; B43K 7/02; B43K 8/02; B43K 8/03; B43K 15/00

USPC ..... 482/121–122, 124, 126–128; 401/6–8

See application file for complete search history.

(56) References Cited

U.S. PATENT DOCUMENTS

| | | | | | |
|---|---|---|---|---|---|
| 3,343,837 | A * | 9/1967 | Grzybowski | A63B 21/0004 | 482/126 |
| 3,396,967 | A | 8/1968 | Brown | | |
| 4,193,593 | A | 3/1980 | Wilson | | |
| 4,305,582 | A * | 12/1981 | Barton | A63F 9/00 | 273/440 |
| 4,489,937 | A * | 12/1984 | Kong | A63B 21/00043 | 482/126 |
| 4,591,151 | A * | 5/1986 | Hensley | A63B 23/14 | 482/126 |
| 4,643,417 | A | 2/1987 | Nieman | | |
| 4,695,049 | A | 9/1987 | Ciemiega | | |
| 4,762,318 | A | 8/1988 | Phillips et al. | | |
| 5,046,726 | A * | 9/1991 | Van Straaten | A63B 21/4045 | 482/125 |
| 5,244,442 | A | 9/1993 | Schill | | |
| 5,614,300 | A | 3/1997 | Cicali et al. | | |
| 5,643,149 | A * | 7/1997 | Grimaldi | A63B 5/20 | 482/122 |
| 6,508,749 | B1 * | 1/2003 | Broadwater | A63B 21/0552 | 482/121 |
| D470,201 | S | 2/2003 | Paull | | |
| D500,101 | S | 12/2004 | Fitzgerald et al. | | |
| 6,860,841 | B1 * | 3/2005 | Mortorano | A63B 21/0004 | 482/126 |
| D556,841 | S | 12/2007 | Oates | | |
| 7,695,413 | B1 * | 4/2010 | Cruz | A63B 21/04 | 482/126 |
| 7,951,051 | B1 | 5/2011 | Brown | | |
| 8,092,353 | B2 | 1/2012 | Yang et al. | | |
| 8,864,637 | B2 * | 10/2014 | Leirer | A63B 23/0211 | 482/121 |
| 8,888,662 | B1 * | 11/2014 | Gomez, Jr. | A63B 69/208 | 482/121 |
| 2004/0132592 | A1 * | 7/2004 | Yu | A63B 21/0004 | 482/126 |
| 2005/0233877 | A1 * | 10/2005 | Lin | A63B 21/00043 | 482/126 |
| 2008/0081747 | A1 * | 4/2008 | Mok | A63B 21/0004 | 482/121 |
| 2008/0182734 | A1 * | 7/2008 | Wu | A63B 21/0004 | 482/126 |
| 2009/0176634 | A1 | 7/2009 | Wu | | |
| 2010/0240505 | A1 * | 9/2010 | Yang | A63B 21/0004 | 482/126 |
| 2012/0178601 | A1 | 7/2012 | Yang et al. | | |

FOREIGN PATENT DOCUMENTS

| | | |
|---|---|---|
| KR | 200100687804 | 3/2007 |
| WO | 00/13752 | 3/2000 |

* cited by examiner

EXERCISE PEN

CROSS-REFERENCE TO RELATED APPLICATIONS

This application is a §371 national stage entry of International Application No. PCT/US2013/060098, filed Sep. 17, 2013, which claims priority to U.S. Provisional Application No. 61/702,016, filed Sep. 17. 2012 and which is expressly incorporated by reference herein in its entirety.

FIELD

The disclosure herein generally relates to exercise devices, and more particularly to an exercise device in a pen form factor.

BACKGROUND

In a modern society that increasingly relies on technical workers that sit at a desk and operate computing devices for prolong periods of time, the opportunities for exercising have diminished. The number or types of exercises in a modern work society are constrained and limited by the modern work environment that includes cramped areas and fragile equipment susceptible to breakage. Existing exercise tools or devices used in gyms are generally deemed inappropriate in modern high technology work environments. Accordingly, an exercise tool or device more appropriate for a diverse number of environments including modern work environments is needed.

SUMMARY

In some embodiments, an exercise pen can include an elongated body having an elongated upper body and an elongated lower body where a lower end of the upper body and an upper end of the lower body can be releasably coupled together, and a resistance tube extending within lumens of the upper and lower bodies, said resistance tube having a first end coupled to a lower portion of the lower body and a second end, opposite the first end, coupled to an upper portion of the upper body.

In some embodiments, an exercise kit can include an elongated body having an elongated upper body and an elongated lower body where a lower end of the upper body and an upper end of the lower body can be releasably coupled, and at least two resistance tubes adapted for extending within lumens of the upper and lower bodies where each of the resistance tubes have different moduli of elasticity. The exercise kit can further include a lower end cap adapted for removable coupling to both (i) a first end of either of the resistance tubes, and (ii) a lower end of the lower body; and an upper end cap adapted for removable coupling to both (i) a second end of either of the resistance tubes, and (ii) an upper end of the upper body.

In some embodiments, a method of exercising includes providing an exercise pen having an elongated body including an elongated upper body and an elongated lower body where a lower end of the upper body and an upper end of the lower body are releasably coupled together, and a resistance tube extending within lumens of the upper and lower bodies, the resistance tube having a first end coupled to a lower portion of the lower body and a second end, opposite the first end, coupled to an upper portion of the upper body. The method further includes decoupling the upper body from the lower body; and stretching the resistance tube by moving the upper body away from the lower body.

These and other features of the present disclosure will become more apparent to one skilled in the art from the following description and claims when read in light of the accompanying drawings.

DETAILED DESCRIPTION

Figures 1, 2:
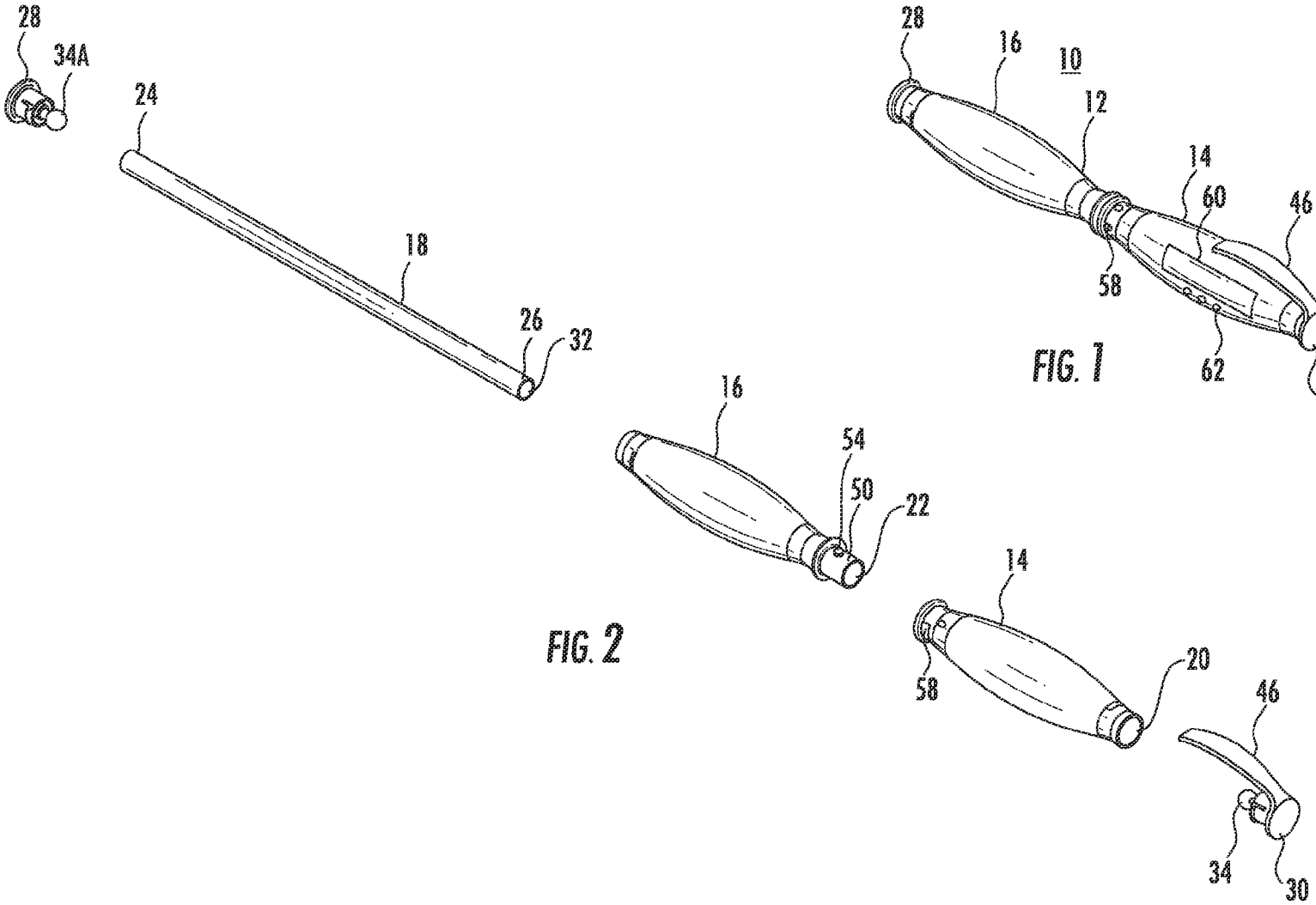
FIG. 1 is a perspective view of the exercise pen described herein.
FIG. 2 is an exploded view of the exercise pen of FIG. 1.
Figure 3:
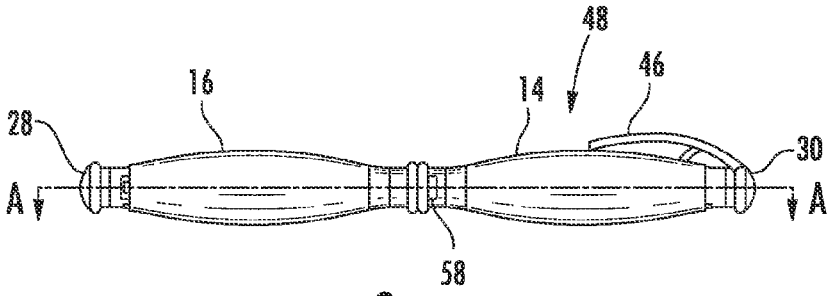
FIG. 3 is a side view of the exercise pen of FIG. 1.

An exercise pen that includes two gripping portions (or handles) linked by a resistance tube is described. The exercise pen can be used for a wide variety of resistance exercises. A kit including the exercise pen and methods of using the exercise pen are also described.

Although referred to as an "exercise pen," it will be understood that the exercise pen can just as easily be used as a stress reliever. For instance, rather than squeezing a stress ball, the user of the exercise pen and simply pull the ends apart as a means of stress relief.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

As shown in FIGS. 1-13, the exercise pen 10 can include an elongated body 12 having an elongated upper body 14 and an elongated lower body 16. A lower end of the upper body 14 and an upper end of the lower body 16 can be releasably coupled together. The exercise pen 10 can also include a resistance tube 18 extending within lumens 20, 22 of the upper and lower bodies 14, 16, respectively. The resistance tube 18 can have a first end 24 coupled to a lower portion of the lower body 16 and a second end 26, opposite the first end 24, coupled to an upper portion of the upper body 14.

The exercise pen 10 can also include a lower end cap 28 adapted for removable coupling to both (i) a first end 24 of the resistance tube 18, and (ii) a lower end of the lower body 16; and an upper end cap 30 adapted for removable coupling to both (i) a second end 26 of the resistance tube 18, and (ii) an upper end of the upper body 14.

Figure 4:
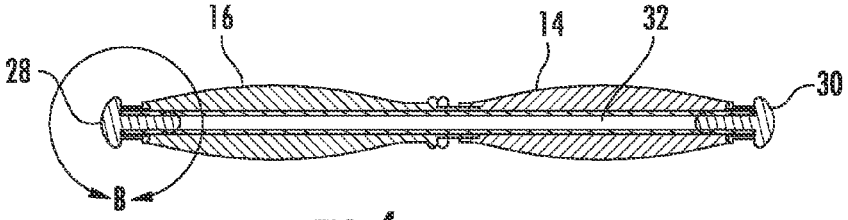
FIG. 4 is a cross-sectional view of the exercise pen of FIG. 3 taken along cut line A-A.
Figure 5:
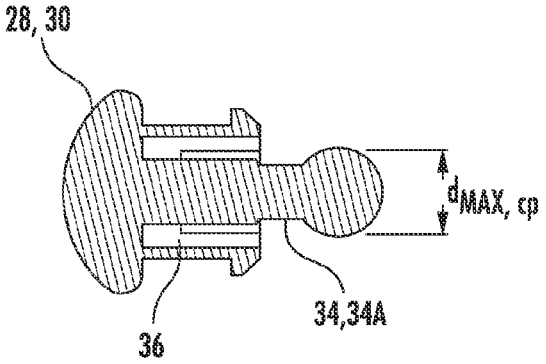
FIG. 5 is a cross sectional view of an end cap in section B of FIG. 4.
Figure 6:
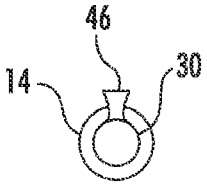
FIG. 6 is an end view of the exercise pen of FIG. 1.
Figure 8:
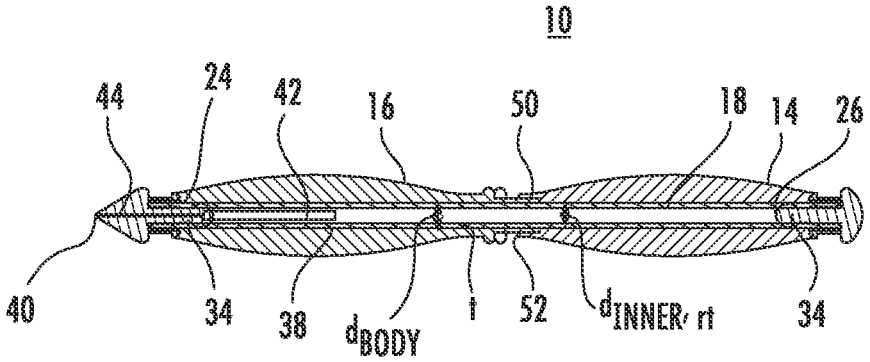
FIG. 8 is a cross-sectional view of an exercise pen where the lower end cap includes a pen.
Figure 9:
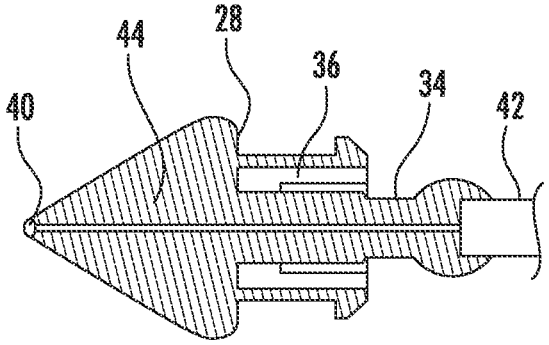
FIG. 9 is a close up of the lower end cap of FIG. 8.

The resistance tube 18 can include a lumen 32. The lower end cap 28, the upper end cap 30, or both 28, 30, can include a coupling projection 34 or 34A adapted to extend within the resistance tube lumen 32. As best shown in FIGS. 5 & 9, the lower end cap 28, the upper end cap 30, or both 28, 30, can also include a cylindrical cavity 36 located distally from the coupling projection 34 or 34A. As shown in FIGS. 4 & 8, the cylindrical cavity 36 can be adapted to receive an end 24, 26 of the resistance tube 18. As used herein, "proximal" refers to the central portion of the exercise pen where the upper and lower bodies are removeably coupled and "distal" refers to the extremities of the exercise pen furthest away from the central portion.

A maximum diameter ($d_{max,\ cp}$) of the coupling projection 34 or 34A can be greater than a relaxed, inner diameter ($d_{inner,\ rt}$) of the resistance tube lumen 32. In such a device, the circumference of the resistance tube 18 must be in a stretched state when the coupling projection 34 is inserted therein. This creates friction to maintain the resistance tube 18 in place when the resistance tube 18 is being stretched during an exercise movement.

The wall 38 of the resistance tube 18 can have a relaxed thickness (t). The maximum diameter of the coupling projection ($d_{max,\ cp}$) plus twice the relaxed thickness (t) can be greater than a diameter ($d_{body}$) of the lumen 20, 22 at the corresponding end of the upper or lower body 14, 16, respectively. In such a device, the minimum gap between the projection and the inner diameter of the upper or lower body lumen 20, 22 will be smaller than the thickness (t) of the resistance tube 18. This creates friction to maintain the resistance tube in place when the resistance tube 18 is being stretched during an exercise movement.

Figure 10:
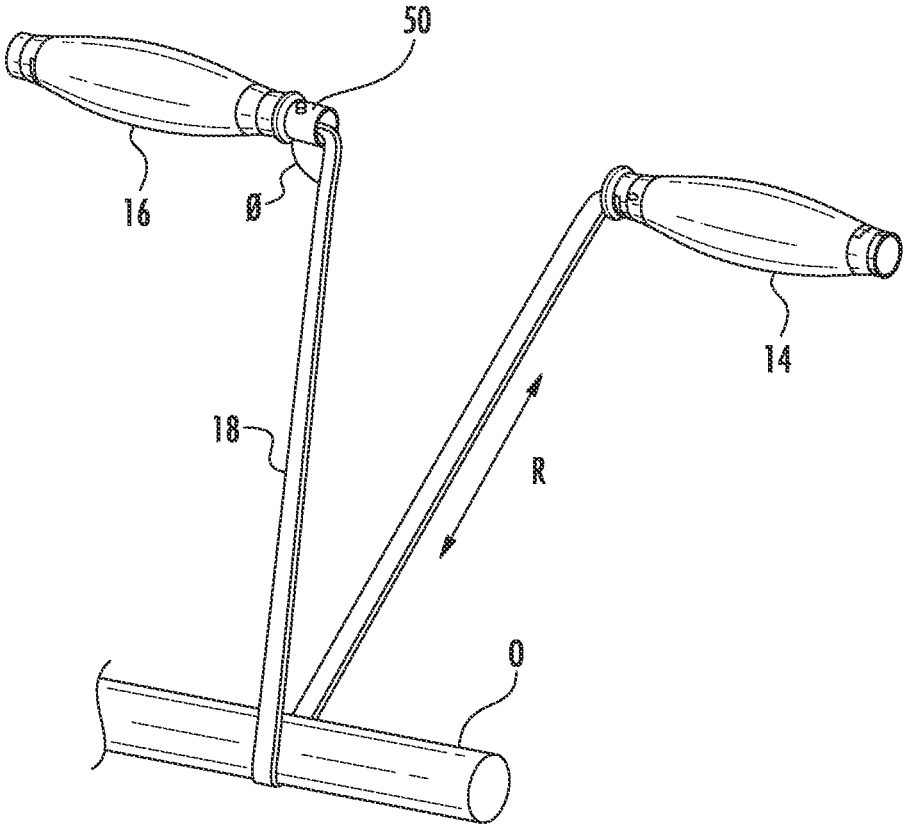
FIG. 10 is a perspective view of the exercise pen with the resistance tube in a stretched state and wrapped around an object so a user can perform a pulling exercise.

When the upper body and lower body 14, 16 are decoupled, the only restraint on movement between the upper body 14 and the lower body 16 is the resistance band 18. A first end 24 of the resistance band 18 can be secured at a lower end of the lower body 16. The first end 24 can terminate within the lower body 16. The second end 26 of the resistance band 18 can be secured to an upper end of the upper body 14. The second end 26 can terminate within the upper body 14. In contrast to conventional, symmetrical, exercise bands that loop through handles, this asymmetric arrangement requires the user to utilize their forearms to stabilize the upper and lower body 14, 16 elements, especially when—as shown in FIG. 10—the upper and/or lower body 14, 16 elements are held at an angle (θ) from the direction of resistance (R).

In some instances, the upper and/or lower body 14, 16 elements can be held substantially perpendicular to the direction of resistance. As used herein substantially perpendicular refers to ±20°, ±15°, ±10°, ±5° or ±less than 5° from perpendicular.

As shown in FIGS. 8 & 9, the lower end cap 28 can include a coupling projection 34 and a distal end of the lower end cap 28 can include a pen tip 40 in fluid communication with an ink reservoir 42 via an ink channel 44 passing through the lower end cap 28. The ink reservoir 42 can extend longitudinally from a proximal end of the lower cap 28 within the lumen 22 of the lower body 16. The ink reservoir 42 can be cylindrical and can have an outer diameter less than a relaxed diameter ($d_{inner,\ rt}$) of the resistance tube lumen 32.

As best shown in FIGS. 1-3, 6 and 7, the upper cap 30 can include a clip 46 adapted to contact an exterior surface 48 of the upper body 14 when the upper cap 30 is coupled to the upper end of the upper body 14. The clip 46 can be used to secure the exercise pen 10 when it is not in use or to secure the upper end 14 in order to perform an exercise. Example of an exercise where the clip 46 might be used to anchor the upper body 14 include any exercises where cable pulleys might be used.

As shown in FIG. 8, the upper end of the lower body 16 can include a coupling projection 50 adapted to be received within a receiving portion 52 of a lower end of the upper body 14. Similarly, the lower end of the upper body 14 can include a coupling projection adapted to be received within a receiving portion of an upper end of the lower body 16.

The coupling projection 50 and the receiving portion 52 can be releasably locked when the coupling projection 50 is positioned within receiving portion 52. The coupling projection 50 and the receiving portion 52 can be generally cylindrical and can be arranged coaxially when the coupling projection 50 is positioned within the receiving portion 52.

Figure 7:
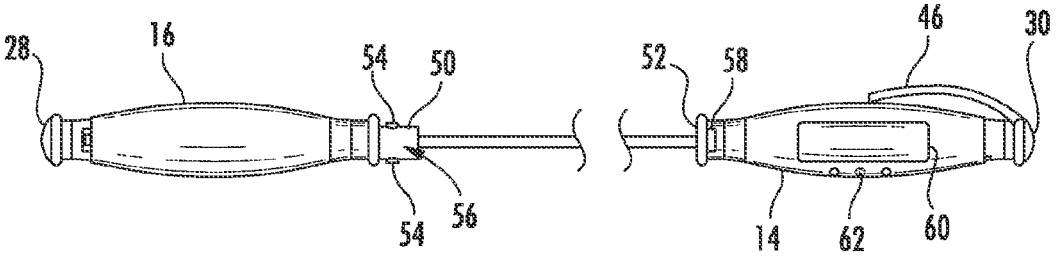
FIG. 7 is a view of the exercise pen of FIG. 1 with the resistance tube in an stretched state.

For example, as shown in FIG. 7, the coupling projection 50 can include at least one pin 54 extending radially from a surface 56 of the coupling projection 50 and the receiving portion 52 can include at least one track 58 for receiving the at least one pin 54 when the coupling projection 50 is inserted into the receiving portion 52. The upper body 14 and lower body 16 can be releasably locked together by positioning the coupling projection 50 within the receiving portion 52 and rotating the upper body 14 relative to the lower body 16 to position the pin 54 in a locked position within the track 58. The at least one track 58 can be L-shaped tracks as shown in the Figures.

Figure 11:
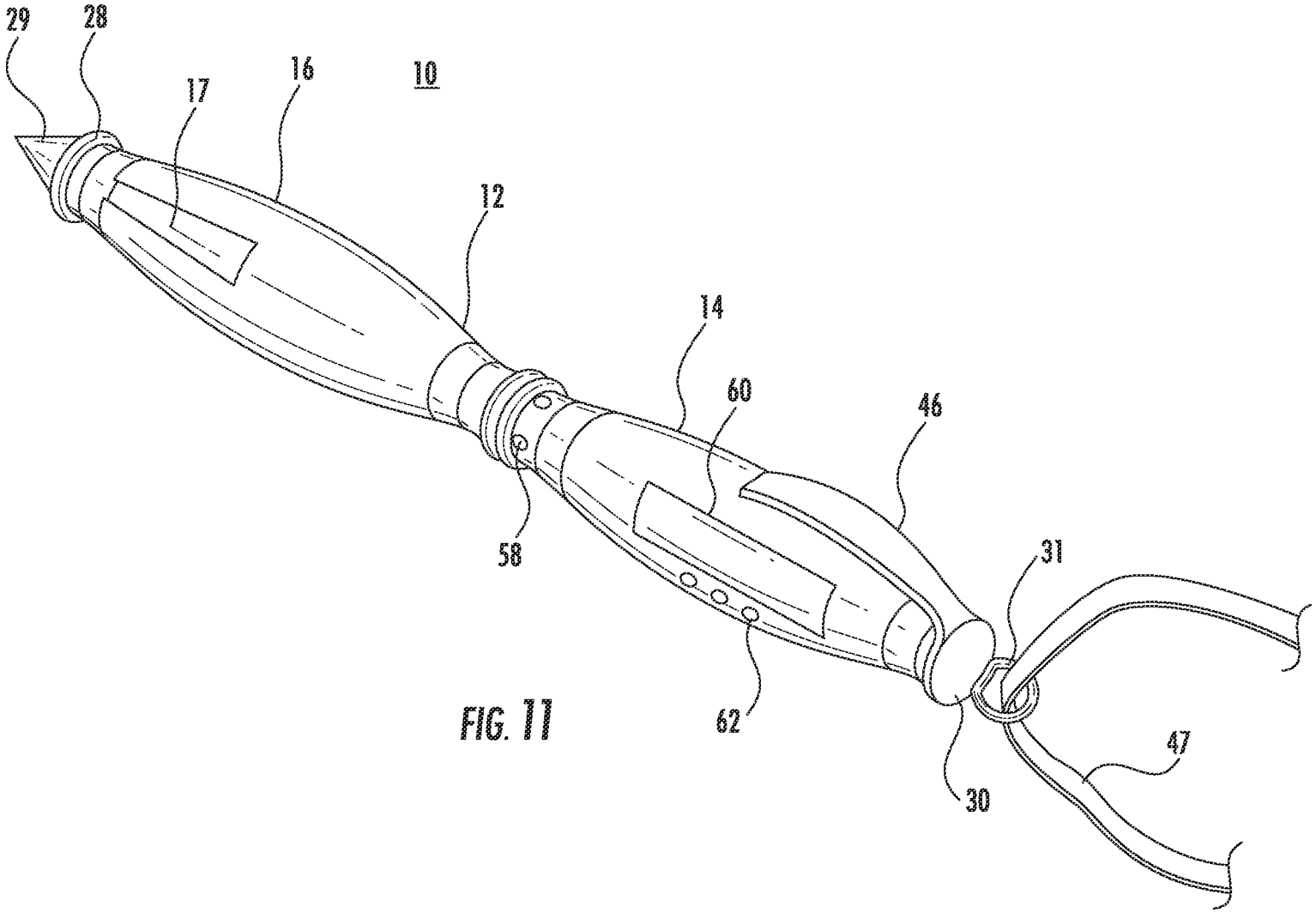
FIG. 11 is a perspective view of a modified version of the exercise pen of FIG. 1, further including a stylus formed on the lower end cap and an eyelet formed on the upper end cap in accordance with the embodiments.
Figure 12:
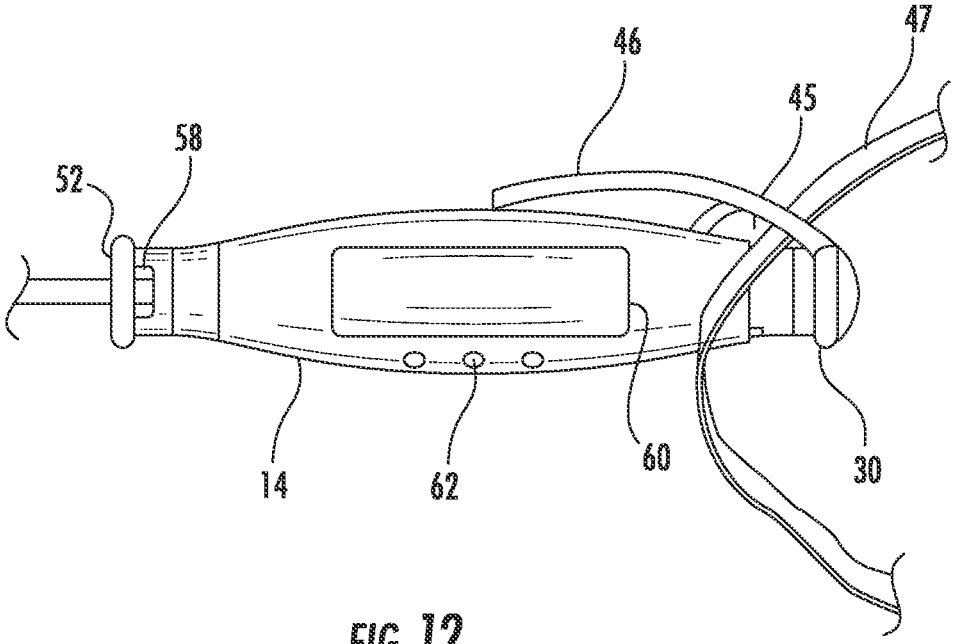
FIG. 12 is a view of a modified version of a portion of the exercise pen of FIG. 1 further including an alternative eyelet in accordance with the embodiments.
Figure 13:
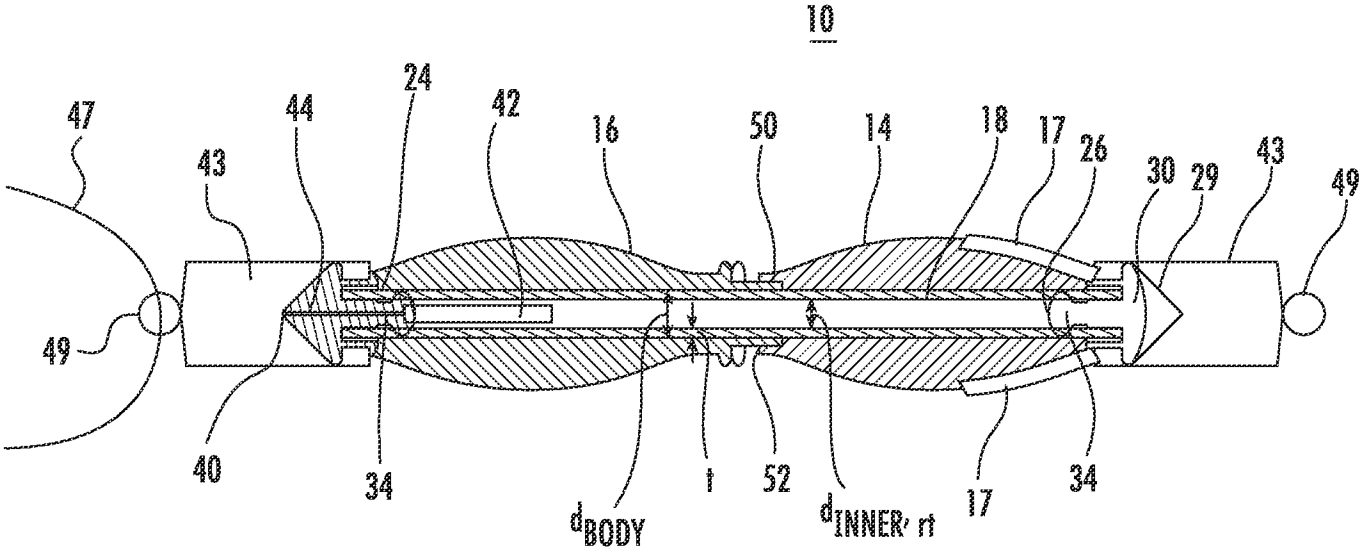
FIG. 13 is a cross-sectional view of an exercise pen where the lower end cap includes a pen and the upper end cap includes a stylus tip.

In some embodiments, as illustrated in FIGS. 11 and 13, the exercise pen 10 can further include a stylus tip 29 coupled to or formed on the lower end cap 28 (as shown in FIG. 11) or coupled to or formed on the upper end cap 30 (as shown in FIG. 13). In some embodiments, the exercise pen 10 can include an eyelet 31 formed on the upper end cap 30 as shown in FIG. 11. In some embodiments, the exercise pen can include an eyelet 49 on a lid 43 that fits over or covers either the pen tip 40 or the stylus tip 29 as shown in FIG. 13. The eyelet 31 in FIG. 11 or the eyelet 49 in FIG. 13 can be adapted for a lanyard 47, or keychain or other retaining mechanism to pass through the eyelet. In another variation as shown in FIG. 12, an eyelet 45 can be formed or coupled to the upper end cap by forming the eyelet as part of the clip 46. Thus, the eyelet 45 and lanyard 47 and/or clip 46 can be used to secure the exercise pen 10 when it is not in use or to secure the upper end 14 in order to perform an exercise.

Referring again to FIG. 11, depending on the touch screen technology used, the stylus tip 29 can be made of rubber that is either conductive or non-conductive or can be made of or include portions that are metal or otherwise conductive and coupled to conductive portions on the elongated body 12. For touch screen technologies, such as capacitive touch screens, where the touch screens are more responsive to bare finger touching, the stylus 29 and at least the lower body 16 can be made of a conductive material which couples to the stylus 29. In one embodiment, the elongated body 12 or at least the lower body 16 can be made of metal such as aluminum which is conductive. In some embodiments where the body 16 is not made of conductive materials, the stylus 29 can be made of conductive material and coupled to a conductive strip 17 formed on or embedded in elongated body 12 (on either the lower body 16 as shown in FIG. 11 or on the upper body 14 as shown in FIG. 13). The conductive strip 17 can be made of metal or other conductive materials and can be shaped in various designs (various strips, spirals, dots, etc.), that are electrically coupled to the conductive portion of the stylus tip 29. Because the capacitive properties of the user's touch will be transferred to the stylus tip 29, the user of the exercise pen 10 can hold the elongated body while touching a conductive lower body (16) or at least some conductive portion of the elongated body 12 (such as the conductive strip 17 in some embodiments or any part of the elongated body if the elongated body 16 is all made of metal) and avoid having to touch the stylus tip 29 when using the pen 10 to a contact the touch screen of a consumer device.

The exercise pen 10 can also include a workout computer. The workout computer can display the time, track workout time, resistance level, number of repetitions, and other statistics regarding the users workout. The workout computer can include a computer readable storage in communication with a processor, as well as, a digital workout display 60 and input buttons 62 in communication with the processor. The input buttons can be used for a wide variety of functions, which include, but are not limited to, changing the display; setting the time; starting or stopping the timer; inputting information about the user or the resistance tubes being used; inputting the number of repetitions; and resetting any of the values being tracked.

An exercise kit is also described. The exercise kit can include an elongated body, including an elongated upper body and an elongated lower body, as described herein, and at least two resistance tubes adapted for extending within lumens of the upper and lower bodies. Each of the resistance tubes can have different moduli of elasticity in order to offer the user differing amounts of resistance. The kit can also include a lower end cap adapted for removable coupling to both (i) a first end of any of said resistance tubes, and (ii) a lower end of said lower body; and an upper end cap adapted for removable coupling to both (i) a second end of any of said resistance tubes, and (ii) an upper end of said upper body.

Each of the resistance tubes can include a lumen. The lower end cap, the upper end cap, or both, can include a coupling projection adapted to extend within lumens of the resistance tubes. The resistance tube lumens can have the same inner diameter, outer diameter or both. Each of the components of the exercise kit described herein can include any of the features and/or dimensions of the exercise pen described elsewhere in this document.

A method of exercising using the exercise pen is also described. The method can include providing an exercise pen as described herein; decoupling the upper body from the lower body; and stretching the resistance tube by moving the upper body away from the lower body. The method can also include coupling the upper body to the lower body by inserting the coupling projection into the receiving portion. The method can further comprise rotating the upper body relative to the lower body in order to lock the pin in the track.

The method can also include providing a second resistance tube; removing the resistance tube from the upper body and the lower body; and coupling a first end of the second resistance tube to a lower portion of the lower body and a second end of the second resistance tube to an upper portion of the upper body. The method can also include stretching the second resistance tube after it is installed in the exercise pen by moving the upper body and the lower body away from one another.

The exercise pen can also include a lower end cap and an upper end cap as described herein. The removing step can include detaching the resistance tube from the upper and lower end caps, while the coupling step can include coupling opposite ends of the second resistance tube to the upper and lower end caps so that the second resistance tube passes within the upper and lower body lumens. Each of the components of the exercise pen used in the method described herein can include any of the features and/or dimensions of the exercise pen described elsewhere in this document.

In general the stretching step can include holding the upper and lower bodies 14, 16 in opposite hands and separating the hands from each other. The stretching can be used to assist with stretching or to produce resistance for strength training and/or physical therapy.

Alternately, as shown in FIG. 10, an intermediate portion of the resistance tube can be secured to an object (O) (e.g., a user's foot, a pull-up bar or other anchor) and the user can grip the upper and lower bodies 14, 16 and move them away from the object (O) either together or in an alternating fashion. Depending on the location of the object (O) relative to the user and how the user's body is positioned, such arrangements can be used to produce resistance similar to that produced by curls, pull-ups or rows.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. An exercise pen system, comprising:

an elongated body, comprising an elongated upper body and an elongated lower body, wherein a lower end of said upper body and an upper end of said lower body can be releasably coupled together;

a first resistance tube extending within lumens of said upper and lower bodies, said first resistance tube having a first end coupled to a lower portion of the lower body and a second end, opposite the first end, coupled to an upper portion of the upper body;

a lower end cap adapted for removable coupling to both (i) a first end of said first resistance tube, and (ii) a lower end of said lower body; and an upper end cap adapted for removable coupling to both (i) a second end of said first resistance tube, and (ii) an upper end of said upper body;

wherein said first resistance tube comprises a lumen, and wherein said lower end cap, said upper end cap, or both, comprise a coupling projection adapted to extend within said first resistance tube lumen.

2. The exercise pen system according to claim 1, wherein said lower end cap, said upper end cap, or both, further comprise, a cylindrical cavity located distally from said coupling projection, said cylindrical cavity adapted to receive an end of said first resistance tube.

3. The exercise pen system according to claim 1, wherein a maximum diameter of said coupling projection is greater than a relaxed, inner diameter of said first resistance tube lumen.

4. The exercise pen system according to claim 1, wherein a wall of said first resistance tube has a relaxed thickness (t), and a maximum diameter of said coupling projection plus twice said relaxed thickness is greater than a diameter of said lumen of said corresponding end of said upper or lower body.

5. The exercise pen system according to claim 1, wherein said lower end cap comprises said coupling projection, and a distal end of said lower end cap comprises a pen tip in fluid communication with an ink reservoir extending from a proximal end of said lower end cap.

6. The exercise pen system according to claim 5, wherein said ink reservoir is cylindrical and has an outer diameter less than a relaxed diameter of said first resistance tube lumen.

7. An exercise pen system, comprising:

an elongated body, comprising an elongated upper body and an elongated lower body, wherein a lower end of said upper body and an upper end of said lower body can be releasably coupled together;

a first resistance tube extending within lumens of said upper and lower bodies, said first resistance tube having a first end coupled to a lower portion of the lower body and a second end, opposite the first end, coupled to an upper portion of the upper body;

a lower end cap adapted for removable coupling to both (i) a first end of said first resistance tube, and (ii) a lower end of said lower body; and an upper end cap adapted for removable coupling to both (i) a second end of said first resistance tube, and (ii) an upper end of said upper body;

wherein said upper end cap comprises a clip adapted to contact an exterior surface of said upper body when said upper end cap is coupled to said upper end of said upper body.

8. An exercise pen system, comprising:

an elongated body, comprising an elongated upper body and an elongated lower body, wherein a lower end of said upper body and an upper end of said lower body can be releasably coupled together; and a first resistance tube extending within lumens of said upper and lower bodies, said first resistance tube having a first end coupled to a lower portion of the lower body and a second end, opposite the first end, coupled to an upper portion of the upper body;

wherein: an upper end of said lower body comprises a coupling projection adapted to be received within a receiving portion of a lower end of said upper body, or a lower end of said upper body comprises a coupling projection adapted to be received within a receiving portion of an upper end of said lower body.

9. The exercise pen system according to claim 8, wherein said coupling projection and said receiving portion can be releasably locked when said coupling projection is positioned within said receiving portion.

10. The exercise pen system according to claim 8, wherein said coupling projection comprises at least one pin extending radially from a surface of said coupling projection and said receiving portion comprises at least one track for receiving said at least one pin when said coupling projection is inserted into said receiving portion.

11. The exercise pen system according to claim 7, wherein said upper end cap or lower end cap includes an eyelet that receives a lanyard.

12. The exercise pen system according to claim 1, wherein said upper end cap or lower end cap comprises a stylus tip coupled to a distal end of said upper end cap or lower end cap.

13. The exercise pen system according to claim 12, wherein the stylus tip is conductively coupled to a conductive portion on the elongated body.

14. The exercise pen system according to claim 10, wherein said upper body and lower body can be releasably locked together by positioning said coupling projection within said receiving portion and rotating the upper body relative to the lower body.

15. The exercise pen system according to claim 1, further comprising a second resistance tube adapted for extending within lumens of said upper and lower bodies, said second resistance tube having a first end adapted to couple to a lower portion of the lower body and a second end, opposite the first end, adapted to couple to an upper portion of the upper body; and wherein said second resistance tube has a different moduli of elasticity than the first resistance tube.

16. The exercise pen system according to claim 7, further comprising a second resistance tube adapted for extending within lumens of said upper and lower bodies, said second resistance tube having a first end adapted to couple to a lower portion of the lower body and a second end, opposite the first end, adapted to couple to an upper portion of the upper body; and wherein said second resistance tube has a different moduli of elasticity than the first resistance tube.

17. The exercise pen system according to claim 8, further comprising a second resistance tube adapted for extending within lumens of said upper and lower bodies, said second resistance tube having a first end adapted to couple to a lower portion of the lower body and a second end, opposite the first end, adapted to couple to an upper portion of the upper body; and wherein said second resistance tube has a different moduli of elasticity than the first resistance tube.

* * * * *